United States Patent [19]

Burnham

[11] Patent Number: 4,625,780

[45] Date of Patent: Dec. 2, 1986

[54] VORTEX CONNECTOR

[76] Inventor: Craig C. Burnham, 26 Dearborn St., Salem, Mass. 01970

[21] Appl. No.: 716,172

[22] Filed: Mar. 26, 1985

Related U.S. Application Data

[63] Continuation-in-part of Ser. No. 466,607, Mar. 22, 1983, abandoned.

[51] Int. Cl.[4] ..... B65B 3/04

[52] U.S. Cl. ..... 141/319; 141/364; 141/392; 138/44; 239/463; 366/336

[58] Field of Search ..... 141/364, 392, 319; 366/336, 338; 239/463; 138/44

[56] References Cited

U.S. PATENT DOCUMENTS

| | | | |
|---|---|---|---|
| 372,090 | 10/1887 | Shaw | 368/94 |
| 2,218,110 | 10/1940 | Hosmer et al. | 239/463 |
| 3,028,032 | 4/1962 | Jones | 141/364 |
| 3,229,723 | 1/1966 | Janton | 138/44 |
| 3,334,899 | 8/1967 | Bosko et al. | 46/41 |
| 3,444,897 | 5/1969 | Erickson | 138/44 |
| 3,615,150 | 10/1971 | Indrunas | 141/364 |
| 4,241,877 | 12/1980 | Hughes | 239/463 |
| 4,336,891 | 6/1982 | Smith | 141/364 |

*Primary Examiner*—Houston S. Bell, Jr.
*Attorney, Agent, or Firm*—Thomas C. Stover, Jr.

[57] ABSTRACT

A vortex connector for threaded plastic bottles is provided in which the connector has a pair of opposed recesses, each connecting with an inner female helically threaded recess, the recesses connecting to one another through an axially elongated constriction venturi. One of the bottles is partially filled with water.

The so-coupled bottles are pivoted so that the water containing bottle is on top, the upper bottle is given a circular swirl or two and the water flows in a clearly discernable whirlpool or vortex from the upper bottle to the lower while the displaced air flows from the lower bottle to the upper through the thus-formed vortex in an educational or entertaining display.

8 Claims, 4 Drawing Figures

VORTEX CONNECTOR

This application is a continuation in part of Ser. No. 06/466,607 filed 3/22/83, now abandoned.

BACKGROUND OF THE INVENTION

1. Field of the Invention

This invention relates to a connector to control the flow of liquids, particularly a vortex connector for liquid flow therethrough.

2. The Prior Art

While couplings for bottles have been disclosed per U.S. Pat. No. 3,028,032 to Jones (1962), U.S. Pat. No. 3,615,150 to Indrunas (1969) and U.S. Pat. No. 4,336,891 to Smith (1982). These disclose the drainage of viscous fluids e.g. creams, lotions, catsup and the like which slowly drain from one container to another through a thin disc or seal and, of course, no vortex can be generated with such slow flow e.g. through a thin disc opening.

Accordingly, there has not been provided a vortex connector that causes a whirlpool effect within a container e.g. a bottle and there is a need and market for such connector which is considerably different from the above prior art drain couplings.

There has now been discovered a vortex connector which generates a vortex flow of liquid passing therethrough.

SUMMARY

Broadly, the present invention provides a vortex connector for at least one bottle having a male helically-threaded neck comprising a hollow tubular-threaded connector having female helical threads disposed internally within at least one end thereof and an axially elongated constriction venturi positioned internally between the ends of the connector. By axially elongated venturi is meant a venturi, at least in part axially thicker than its opening diameter or width.

BRIEF DESCRIPTION OF THE DRAWINGS

The invention will become more apparent from the following detailed Specification and drawings in which.

DESCRIPTION OF PREFERRED EMBODIMENT

Figure 1:
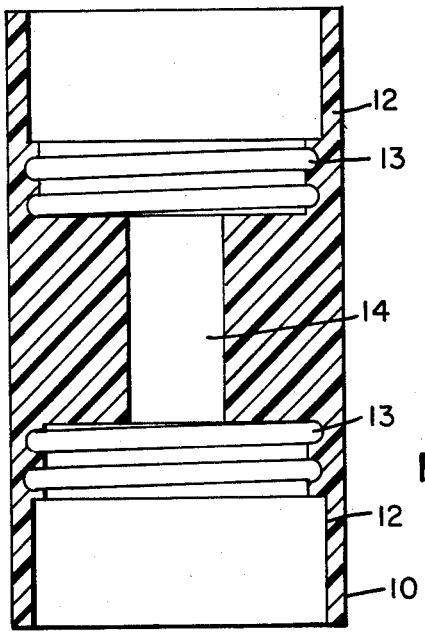
FIG. 1 is a sectional elevation view of a vortex connector embodying the present invention.
Figure 2:
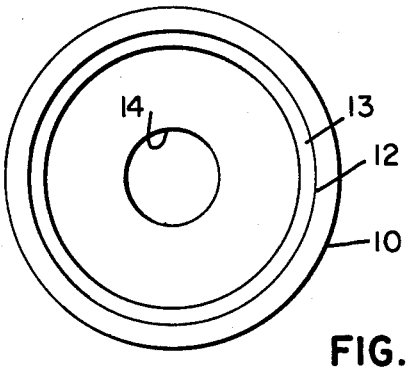
FIG. 2 is a plan view of the vortex connector of FIG. 1.

Referring in more detail to the drawings, vortex connector 10 has at each end, a recess 11 defined by continuous bore portion 12 and an inner portion having female helical (rope) threads 13, as shown in FIG. 1. The two recesses 11 are connected by elongated constriction venturi 14, as shown in FIGS. 1 and 2. The female helical threads 13 are adapted to fit to matching male threads of one or two bottles as discussed hereafter with respect to FIG. 4.

Figure 3:
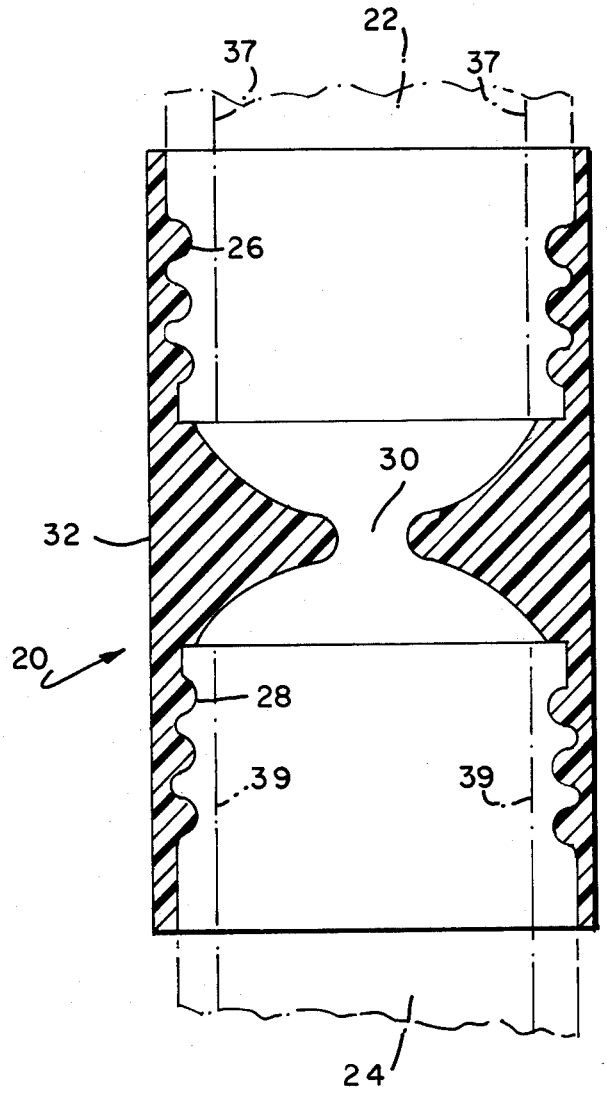
FIG. 3 is a sectional elevation view of another vortex connector embodying the present invention and FIG. 4 is an elevation view of the vortex connector of FIG. 3 in operation.

In another embodiment, constriction venturi 20 has two opposed recesses 22 and 24 and female helical threads 26 and 28, which recesses are separated by constriction venturi 30, as shown in FIG. 3. The constriction venturi 30 is axially elongated at the base 32 thereof near the perpherery of the connector 20 but decreases axially in thickness toward the venturi opening 34, as shown in FIG. 3.

Figure 4:
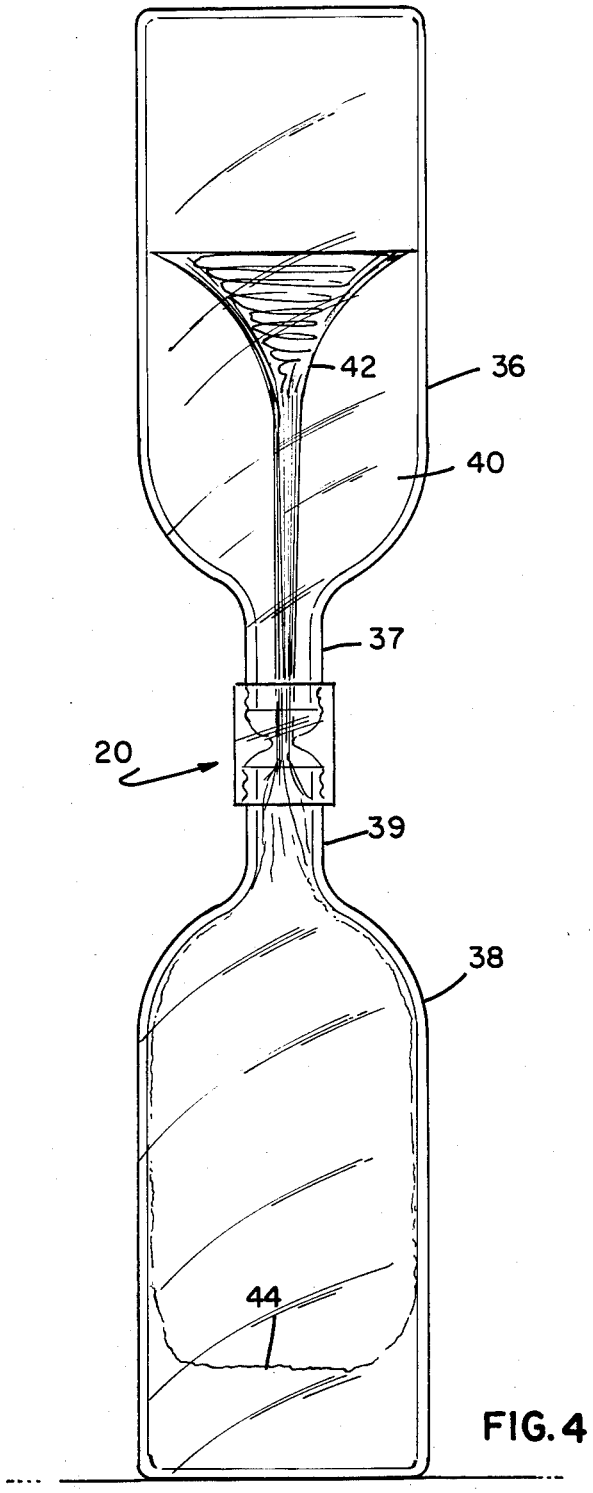

Two containers, e.g. carbonated beverage bottles 36 and 38, having threaded necks 37 and 39 are screwed into the vortex connector 20 and its female helical threads 28 and 26, respectively, the lower bottle containing liquid e.g. water such as shown in FIGS. 4 and 3.

In operation, the coupled bottles 36 and 38 are inverted so that the liquid is in the top bottle i.e. bottle 36 of FIG. 4, the upper bottle is by hand given one or more axial turns or revolutions which together with the vortex connector causes the liquid 40 to swirl and form a vortex 42, which permits the air in the lower bottle 38 to flow upwardly through the vortex 42 while the liquid descends around it and flows down the inner edges 39 of the bottle 38 collecting at the bottom thereof while the water level 44 rises, as shown or indicated in FIG. 4. When the upper bottle 36 is drained, the coupled assembly can be inverted and the vortex flow repeated in an entertaining or educational display.

Accordingly, the vortex generator or connector of the invention is a low-cost product which readily converts one or more containers e.g. plastic bottles to a vortex assembly which produces vortical, whirlpool or tornado-like spinning motions in liquid e.g. water and the like and can permit scientific or educational study thereof as well as entertainment for young and old in observing such action.

The vortex connector of the invention serves the added purpose of connecting together of two containers or bottles of the same or different sizes and also provides a facile method for mixing liquids or other ingredients by the whirling flow of liquids or fluids from one container to the other.

As discussed above, the vortex connector of the invention has an axially elongated constriction venturi therein, either throughout, as illustrated in FIG. 1 or axially elongated at the base thereof and decreasing axially in thickness toward the venturi opening, e.g. as shown in FIG. 3.

Both of the axially elongated venturis serve to readily generate whirlpools or vortices for rapid liquid flow therethrough as discussed above.

The vortex connector of the invention can be made of wood, plastic or other materials and is desirably made of plastic and preferably transparent plastic for further viewing of the liquid or fluid flow therethrough.

Various threaded containers can be connected to or be coupled by the vortex connector of the invention, including glass and plastic bottles and preferably transparent plastic bottles of the same or different sizes, so that the vortex flow of liquid from one bottle to the other through the vortex connector of the invention can readily be seen.

As noted above, at least some portion of the venturi is axially elongated e.g. longer at least at the base thereof than the width or diameter of the venturi opening. Further, the venturi opening is desirably less than half of the width or diameter of the threaded recesses of the vortex connector of the invention.

What is claimed is:

1. A vortex connector for at least one bottle having a male helically-threaded neck comprising a hollow tubular-threaded connector having female helical threads disposed internally within at least one end thereof and an axially elongated constriction venturi positioned internally between the ends of said connector such that liquid in said bottle can swirl about a vortex in flowing through said connector.

2. The vortex connector of claim 1 having helical threads internally disposed within each end thereof with said constriction venturi being positioned internally between said threaded ends.

3. The vortex connector of claim 2 wherein said constriction venturi is elongated at the opening thereof.

4. The vortex connector of claim 2 wherein said constriction venturi is elongated at its base proximate the perpherery of said tubular-threaded connector and tapers in axially thickness toward the opening thereof within said connector.

5. The vortex connector of claim 2 being made of plastic.

6. The vortex connector of claim 2 wherein the diameter of said venturi opening is less than half the diameter of the threaded opening within said connector.

7. The vortex connector of claim 2 wherein at least one of said bottles is connected to each end of said connector.

8. The vortex connector of claim 7 wherein one of said bottles is partially filled with liquid.

* * * * *